US009038508B1

(12) United States Patent
Hodges

(10) Patent No.: US 9,038,508 B1
(45) Date of Patent: May 26, 2015

(54) PIVOTING OPEN-ENDED RATCHETING DEVICE

(71) Applicant: Stephen W. Hodges, Russellville, AR (US)

(72) Inventor: Stephen W. Hodges, Russellville, AR (US)

( * ) Notice: Subject to any disclaimer, the term of this patent is extended or adjusted under 35 U.S.C. 154(b) by 0 days.

(21) Appl. No.: 14/341,063

(22) Filed: Jul. 25, 2014

Related U.S. Application Data

(60) Provisional application No. 61/941,750, filed on Feb. 19, 2014.

(51) Int. Cl.

| | |
|---|---|
| ***B25B 13/46*** | (2006.01) |
| ***B25B 23/00*** | (2006.01) |
| ***B25B 13/48*** | (2006.01) |
| ***B25B 23/16*** | (2006.01) |
| ***B25G 1/10*** | (2006.01) |

(52) U.S. Cl.
CPC ..... *B25B 23/0028* (2013.01); *B25B 13/461* (2013.01); *B25B 13/481* (2013.01); *B25B 23/16* (2013.01); *B25G 1/105* (2013.01)

(58) Field of Classification Search
CPC ..... B25G 1/063; B25G 1/06; B25B 13/481; B25B 13/461; B25B 13/12; B25B 13/16; B25B 13/18
USPC ..... 81/63.1, 77, 177.8, 177.7, 125.1, 385, 81/393, 489
See application file for complete search history.

(56) References Cited

U.S. PATENT DOCUMENTS

| | | | | |
|---|---|---|---|---|
| 1,217,217 | A * | 2/1917 | Reagan, Jr. | 81/177.8 |
| 4,196,491 | A | 4/1980 | Baril | |
| 5,207,755 | A | 5/1993 | Ampian | |
| 5,806,129 | A | 9/1998 | Nelson | |
| 5,987,692 | A | 11/1999 | Sizemore | |
| 8,186,248 | B1 * | 5/2012 | Considine | 81/177.3 |
| 2007/0067936 | A1 | 3/2007 | Hodges | |
| 2007/0163405 | A1 * | 7/2007 | Hsieh | 81/177.85 |
| 2011/0239827 | A1 * | 10/2011 | Hart | 81/60 |

* cited by examiner

*Primary Examiner* — Lee D Wilson
*Assistant Examiner* — Melanie Alexander
(74) *Attorney, Agent, or Firm* — Robert C. Montgomery; Montgomery Patent & Design, LLC

(57) ABSTRACT

A ratcheting device includes a handle member including a first end and an opposed second end, a ratchet head pivotably connected to the first end of the handle member, and a ring grip pivotably connected to the second end of the handle member.

17 Claims, 4 Drawing Sheets

PIVOTING OPEN-ENDED RATCHETING DEVICE

RELATED APPLICATIONS

The present invention was first described in and claims the benefit of U.S. Provisional Application No. 61/941,750, filed Feb. 19, 2014, the entire disclosures of which are incorporated herein by reference.

FIELD OF THE INVENTION

The present invention relates generally to ratcheting tools and, more particularly, to a hand tool including a pivoting ratchet-end and a pivoting operational-end.

BACKGROUND OF THE INVENTION

Conventional ratchets include a tool-engaging or fastener-engaging head portion that is attached to a handle so that a user may position of the head portion relative to a work piece or fastener. One (1) problem with conventional ratchets is that the location where the ratchet head is needed is narrow or otherwise hard to reach.

As a solution, ratchets having ratchet heads that pivot with respect to the wrench's handle for adjusting fasteners in hard to reach locations were developed. However, since only the ratchet head disposed at an end of the ratchet handle is adjustable according to a particular need, the operational angle of the grip end of the ratchet wrench is not adjustable, therefore, the applicability of the conventional pivot-head ratchet wrench is limited.

Accordingly, there is a need for a ratcheting device that addresses the problems in the art.

SUMMARY OF THE INVENTION

The inventor has recognized the aforementioned inherent problems and lack in the art and observed that there is a need for a ratcheting device that affords a user the ability to adjust not only the position of a ratchet head but also an operational end or grip end of a ratchet handle. The development of the present invention, which will be described in greater detail herein, substantially departs from conventional solutions to fulfill this need.

In one (1) embodiment, the disclosed ratcheting device includes a handle member including a first end and an opposed second end, a ratchet head pivotably connected to the first end of the handle member, and a ring grip pivotably connected to the second end of the handle member.

In another embodiment, the disclosed ratcheting device includes a handle member including an upper handle member including a first end and an opposed second end, and a lower handle member including a first end and an opposed second end. The upper handle member and the lower handle member are spaced apart and parallel. The ratcheting device includes a ratchet head pivotably connected to the first end of the upper handle member and the first end of the second handle member. The ratchet head includes a bi-directional ratcheting mechanism. The ratcheting device includes a ring grip pivotably connected to the second end of the upper handle member and the second end of the second handle member. The ring grip includes an annularly-shaped body defining a circular ring grip aperture.

In another embodiment, the disclosed ratcheting device includes the first end of the upper handle member that is pivotably connected to the ratchet head at a first upper hinge.

The ratcheting device includes the first end of the lower handle member that is pivotably connected to the ratchet head at a first lower hinge. The ratcheting device includes the second end of the upper handle member that is pivotably connected to the ring grip at a second upper hinge. The ratcheting device includes the second end of the lower handle member is pivotably connected to the ring grip at a second lower hinge. The first upper hinge includes an integral first upper handle knuckle extending from the first end of the upper handle member and an integral spaced apart upper pair of head knuckles extending from the ratchet head to receive the first upper handle knuckle. The first upper handle knuckle being secured between the upper pair of head knuckles by a first pin. The first lower hinge includes an integral first lower handle knuckle extending from the first end of the lower handle member and an integral spaced apart lower pair of head knuckles extending from the ratchet head to receive the first lower handle knuckle. The first lower handle knuckle being secured between the lower pair of head knuckles by a second pin. The second upper hinge includes an integral second upper handle knuckle extending from the second end of the upper handle member and an integral spaced apart upper pair of grip knuckles extending from the ring grip to receive the second upper handle knuckle. The second upper handle knuckle being secured between the upper pair of grip knuckles by a third pin. The second lower hinge includes an integral second lower handle knuckle extending from the second end of the lower handle member and an integral spaced apart lower pair of grip knuckles extending from the ring grip to receive the second lower handle knuckle. The second lower handle knuckle being secured between the lower pair of grip knuckles by a fourth pin.

In yet another embodiment, the disclosed ratcheting device includes the ratchet head including a ratchet head pivot range of motion of approximately ninety degrees (90°) relative to the first end of the handle member, and the ring grip including a ring grip pivot range of motion of approximately ninety degrees (90°) relative to the second end of the handle member. The ratchet head occupies a first reference plane throughout the ratchet head pivot range of motion. The ring grip occupies a second reference plane throughout the ring grip pivot range of motion. The first reference plane and the second reference plane are parallel regardless of a position of the ratchet head and the ring grip.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
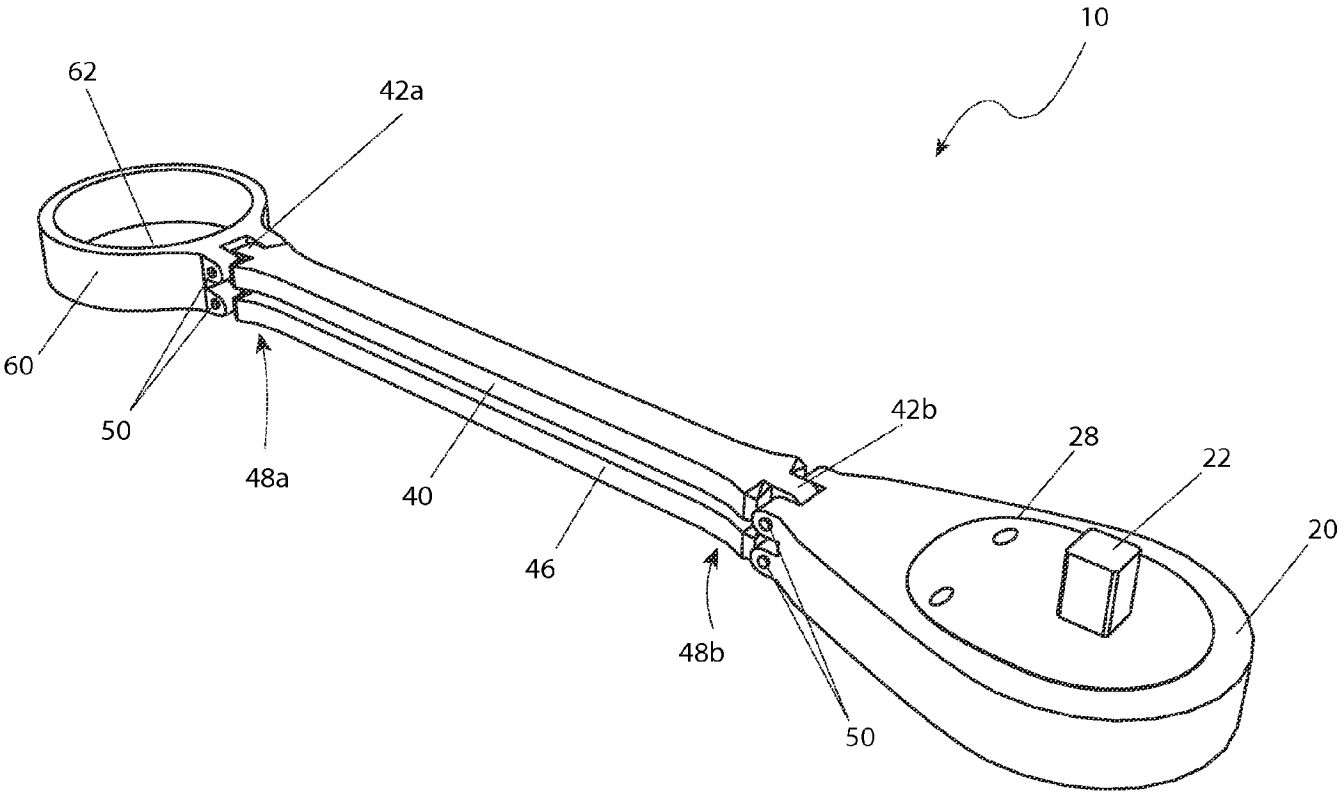
FIG. 1 is a perspective view of one embodiment of the disclosed split handle ratchet tool.

10 split handle ratchet tool
20 ratchet head
21*a* first alternate position
21*b* second alternate position
22 drive
23 directional switch
24 switch aperture
26 gear
28 cover plate
40 upper handle member
42*a* first upper handle hinge
42*b* second upper handle hinge
46 lower handle member
48*a* first lower handle hinge
48*b* second lower handle hinge
50 pivot pin
51 pivot pin aperture
60 ring grip
62 ring grip aperture
100 user finger
105 fastener
110 socket

DETAILED DESCRIPTION OF THE PREFERRED EMBODIMENT

In accordance with the invention, the best mode is presented in terms of a one or more of the disclosed embodiments, herein depicted within FIGS. 1 through 4. However, the disclosure is not limited to a single described embodiment and a person skilled in the art will appreciate that many other embodiments are possible without deviating from the basic concept of the disclosure and that any such work around will also fall under its scope.

Further, those skilled in the art will recognize that other styles and configurations can be incorporated into the teachings of the present disclosure, and that the example configurations shown and described herein are for the purpose of clarity and disclosure and not by way of limitation.

As used herein, the singular terms "a", "an", and "the" do not denote a limitation of quantity, but rather denote the presence of at least one (1), as well as a plurality of, the referenced items, unless the context clearly indicates otherwise.

As used herein, the terms "first", "second", "third", etc. are used as labels to describe various elements, features, and/or components, and are not intended to impose ordinal, positional, or hierarchical requirements on the referenced items, unless other indicated. For example, such terms may be used to distinguish one (1) element from another element.

As used herein, relative terms such as "front", "rear", "left", "right", "top", "bottom", "below", "above", "upper", "lower", "horizontal", or "vertical" are used to describe a relationship of one (1) element, feature and/or region to another element, feature and/or region as illustrated in the figures.

Referring to FIGS. 1-4, disclosing a split handle ratchet tool (herein described as the "device") 10, where like reference numerals represent similar or like parts. Generally, the device 10 includes a ratchet-type tool including a selectively angled two-part handle member (e.g., upper handle member 40 and lower handle member 46) while mechanically maintaining parallelism between a ratchet head 20 and opposing ring grip 60. The device 10 can be scaled to provide various sized drives 22, such as one-quarter inch (¼ in.), three-eighths inch (⅜ in.), one half inch (½ in.), etc. Furthermore the device 10 can be introduced having various overall lengths; however, those skilled in the art will appreciate that a relatively small model of the device 10 (e.g., approximately six inches (6 in.) in length) would be especially useful in tight places, such as under a vehicle dashboard and the like.

Figure 2:
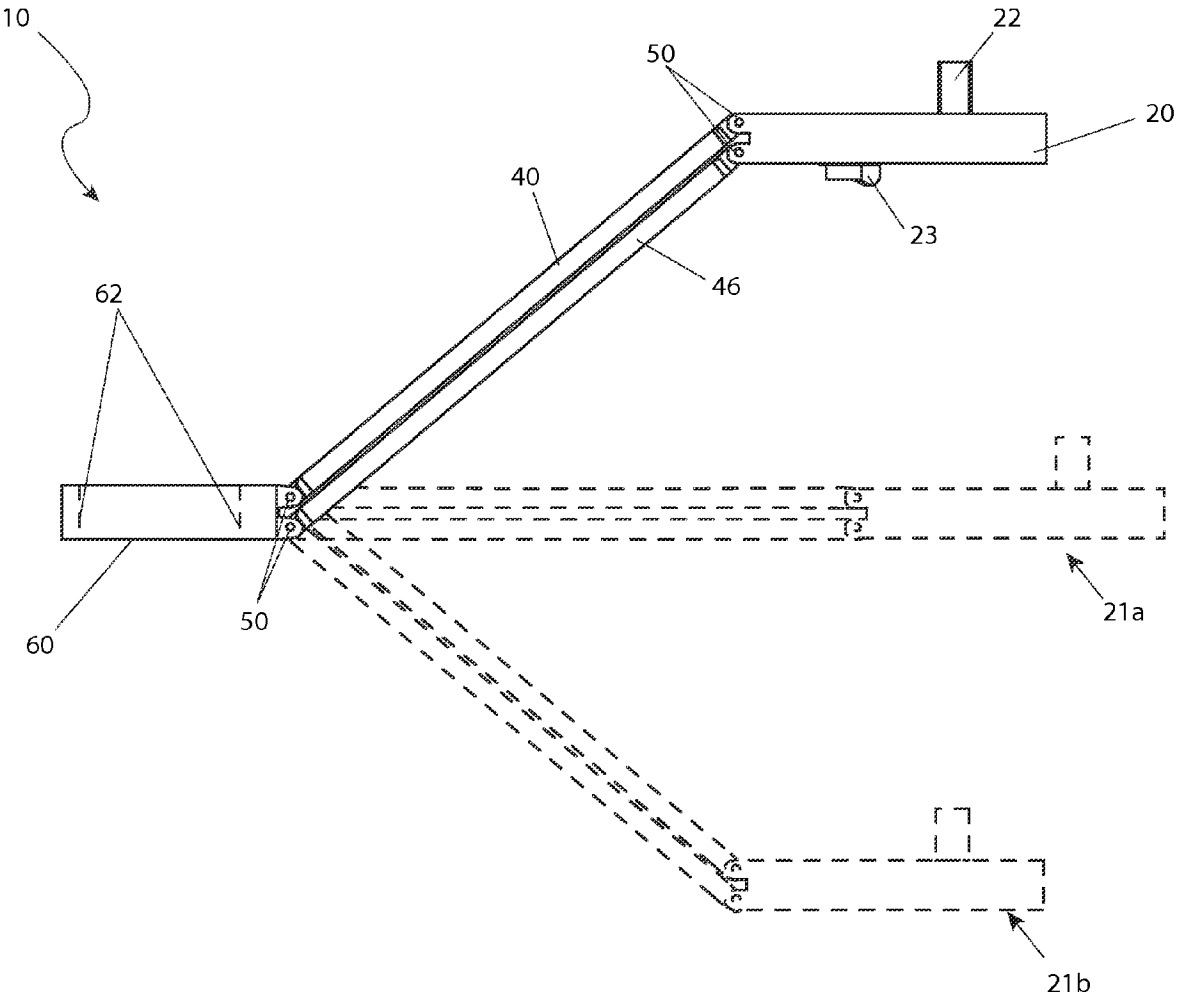
FIG. 2 is a side view of the split handle ratchet tool depicting various operable configurations.

Referring to FIGS. 1 and 2, the device 10 includes a ratchet head 20, an upper handle member 40, a lower handle member 46, and a ring grip 60. The handle members 40, 46 each include a rigid linear connecting member being attached at one (1) end to the ratchet head 20 and at an opposing end to the ring grip 60 using respective pivot pins 50.

The handle members 40, 46 are arranged in a parallel (e.g., over-under) manner. The upper handle member 40 is attached to the ring grip 60 via a first upper handle hinge 42*a* made up of interconnected elements that are integrally-molded into the upper handle member 40 and the ring grip 60. The first upper handle hinge 42*a* is secured by a pivot pin 50 that passes through a pivot pin aperture 51 of the first upper handle hinge 42*a* and is retained via a friction fit.

In a similar manner, the opposing end of the upper handle member 40 is attached to the ratchet head 20 via a second upper handle hinge 42*b* made up of interconnected elements that are integrally-molded into the upper handle member 40 and ratchet head 20 and is secured with pivot pin 50 and pivot pin aperture 51.

The subjacent (e.g., under) lower handle member 46 is attached to the ring grip 60 via a first lower handle hinge 48*a* secured using a pivot pin 50 and to the ratchet head 20 via a second lower handle hinge 48*b* secured using a pivot pin 50.

Referring to FIG. 2, the pivot pins 50 are rotatingly attached to the handle members 40, 46, thereby allowing a relative angle to occur between the handle members 40, 46, and the ratchet head 20 and ring grip 60. The device 10 is depicted in FIG. 2 having an upwardly angled configuration (shown in solid lines), as well as being positioned horizontally (as depicted by a first alternate position 21*a* and shown in broken lines), and angled downwardly (as depicted here by a second alternate position 21*b* and shown in broken lines). Due to the parallel nature of the handle members 40, 46 and respective pivot pins 50 within the ratchet head 20 and ring grip 60, the ratchet head 20 and ring grip 60 are retained within respective parallel plains regardless of the relative angles of the handle members 40, 46.

Figure 3:
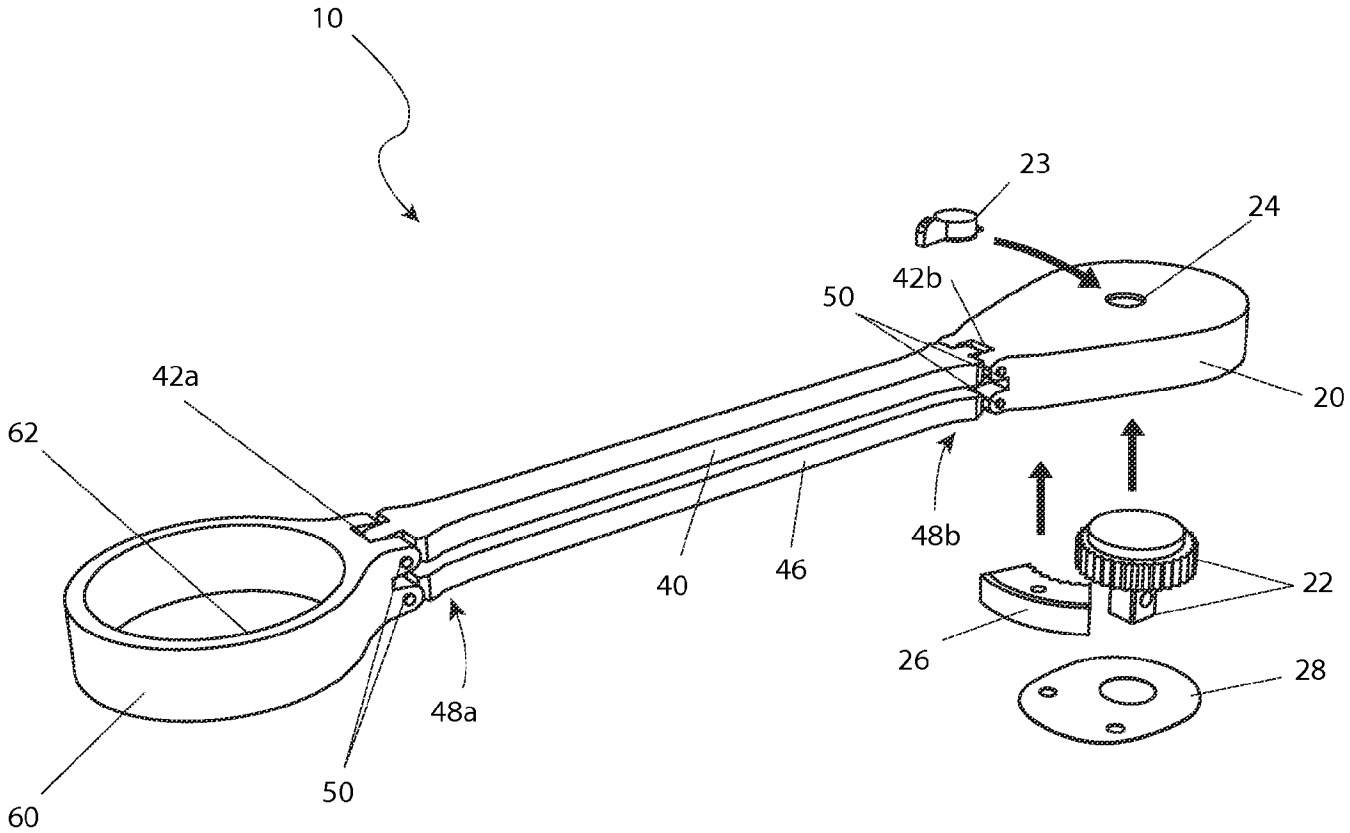
FIG. 3 is an exploded view of the split handle ratchet tool depicting the major internal components of the ratchet head; and, FIG. 4 is an environmental view of the split handle ratchet tool depicting an in-use state.

Referring to FIG. 3, the ratchet head 20 includes a ratcheting mechanism. Ratcheting mechanisms of this type are well known in the art. As one (1) example, the ratcheting mechanism can be similar to the ratcheting mechanism of the ratchet wrench disclosed in U.S. Pat. No. 6,543,316 filed on Mar. 14, 2001, the disclosure of which is herein incorporated by reference in its entirety. However, those skilled in the art will recognize that other ratcheting mechanisms having more, less, or different components or various different designs can be utilized without deviating from the teachings of the present disclosure, and as such should not be interpreted as a limiting factor.

In one (1) example construction, the device 10 includes internal components that are well known in the art and provide conventional selectable bi-directional operation. For example, the device 10 includes major components such as, but not limited to: a gear-type ratchet drive 22, a directional switch 23, a gear 26, and a cover plate 28. In use, the directional external switch 23 is positioned within and passes through a switch aperture 24. The switch 23 is manually rotated to position an engaged internal gear 26 against the drive 22 to deliver one-way clockwise or counterclockwise torque in a known manner.

Figure 4:
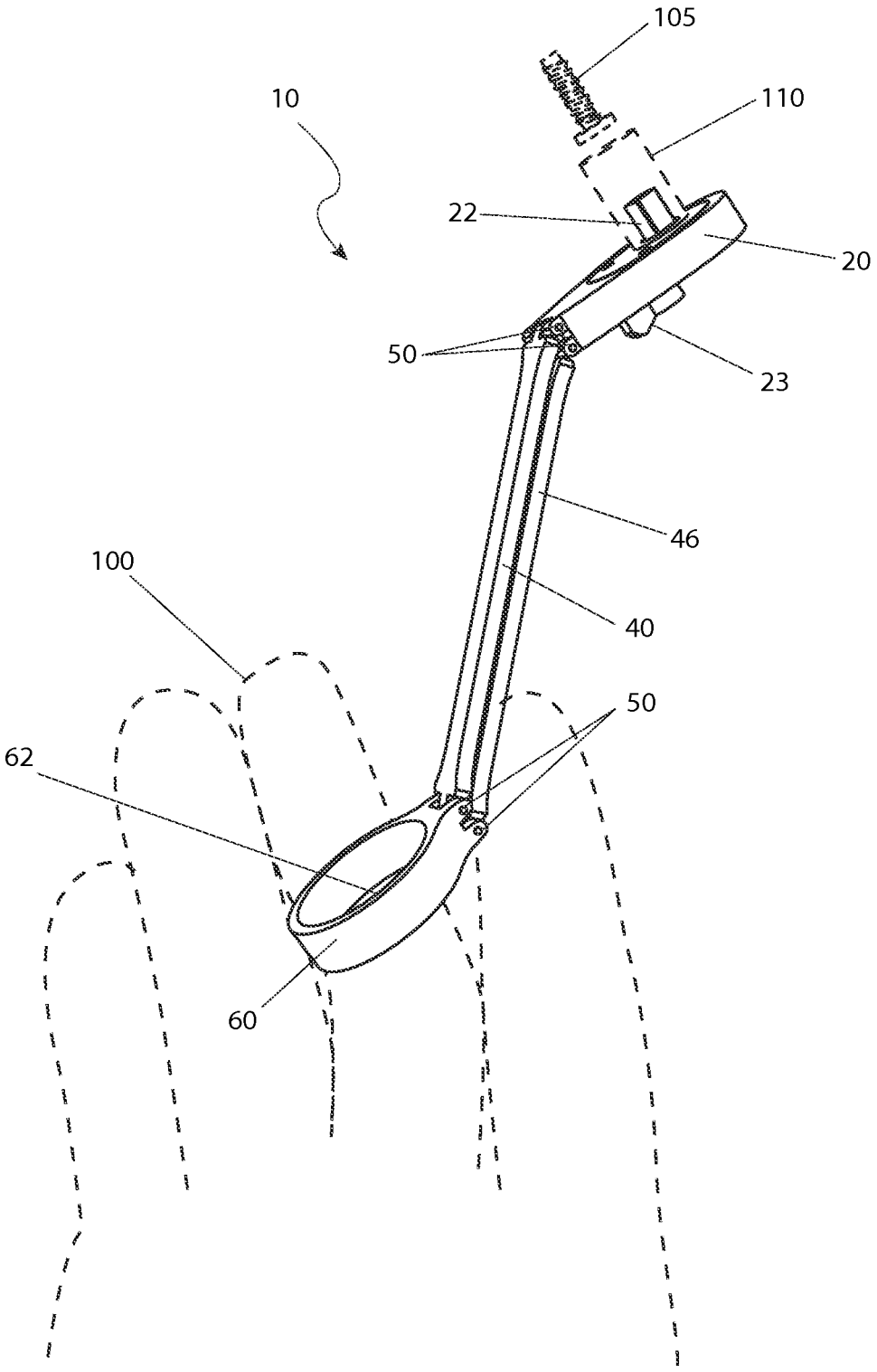

Referring to FIG. 4, a circular embodiment of the ring grip 60 of the device 10 is depicted here being particularly sized for use upon a user's finger 100 to enhance control and gripping of the device 10 to avoid dropping the device 10 during use. However, those skilled in the art will appreciate that the ring grip 60 of the device 10 can be provided having different shapes and corresponding ring grip apertures 62 being suitable to encompass a plurality of fingers 100 without deviating from the teachings of the present disclosure, and as such should not be interpreted as a limiting factor.

As depicted in FIG. 4, while retaining the device 10 upon a user's finger 100, another finger 100 can be used to manipulate a relative angle of the handle members 40, 46 to position and align a socket 110 being mounted to the ratchet head 20 to a fastener 105 as needed.

Those skilled in the art will recognize that other styles and configurations of the disclosed device 10 can be easily incorporated into the teachings of the present disclosure, and only particular configurations have been shown and described for purposes of clarity and disclosure and not by way of limitation of scope.

The disclosed embodiments of the device 10 can be utilized by the common user in a simple and effortless manner with little or no training. After initial purchase or acquisition of the device 10, it would be installed as illustrated in FIGS. 1, 2, and 4.

One (1) embodiment of the disclosed method for utilizing the device 10 includes the following steps: 1). procuring a model of the device 10 having a desired size drive 22 and overall length; 2). installing a desired drive socket 10, or similar tool element which fits the drive 22; 3). placing the ring grip 60 over a user's finger 100; 4). using remaining fingers 100 to manipulate the handle members 40, 46, as desired, to obtain a desired position of the ratchet head 20; 5). engaging a fastener 105 or other rotating item with the device 10 and socket 110; 6). rotating the ring grip 60 to rotate the ratchet head 20 and deliver a torque to the fastener 105; and 7). repeating the previous steps for additional fasteners 105.

Accordingly, a user of the disclosed device 10 benefits from improved gripping and access to difficult to reach fasteners 105.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A ratcheting device comprising:

a handle member comprising:

an upper handle member comprising a first end and an opposed second end; and, a lower handle member comprising a first end and an opposed second end;

a ratchet head pivotably connected to said first end of said upper handle member and said first end of said lower handle member; and, a ring grip pivotably connected to said second end of said handle member upper handle member and said second end of said lower handle member;

wherein said ratchet head occupies a first reference plane during use;

wherein said ring grip occupies a second reference plane during use;

wherein said upper handle member and said lower handle member mechanically maintain said first reference plane and said second reference plane in a parallel relationship regardless of a pivoted position of said ratchet head and said ring grip relative to said handle member in response to pivoting movement of one of said ratchet head or said ring grip; and, wherein said ratchet head and said ring grip each pivot perpendicularly relative to said first and second reference planes of said upper and lower handle members, respectively.

2. The device of claim 1, wherein said upper handle member and said lower handle member are parallel.

3. The device of claim 1, wherein said upper handle member and said lower handle member are spaced apart.

4. The device of claim 1, wherein said first end of said upper handle member is pivotably connected to said ratchet head at a first upper handle hinge; and, said second end of said upper handle member is pivotably connected to said ring grip at a second upper handle hinge.

5. The device of claim 1, wherein said lower handle member comprises:

said first end of said lower handle member is pivotably connected to said ratchet head at a first lower handle hinge; and, said second end of said lower handle member is pivotably connected to said ring grip at a second lower handle hinge.

6. The device of claim 1, wherein said ratchet head comprises a ratcheting mechanism.

7. The device of claim 6, wherein said ratcheting mechanism is bi-directional.

8. The device of claim 1, wherein said ratchet head comprises:

a gear-type ratchet drive; and, a gear operatively connected to said ratchet drive.

9. The device of claim 8, wherein said ratchet head further comprises a directional switch operatively connected to said gear to control bi-directional rotation of said ratchet drive.

10. The device of claim 1, wherein said ring grip comprises an annularly-shaped body defining a circular ring grip aperture.

11. The device of claim 10, wherein said ring grip aperture comprises a size suitable to receive at least one human finger.

12. The device of claim 1, wherein said ratchet head comprises a pivot range of motion of approximately ninety degrees.

13. The device of claim 1, wherein said ring grip comprises a pivot range of motion of approximately ninety degrees.

14. A ratcheting device comprising:

a handle member comprising:

an upper handle member comprising a first end and an opposed second end; and, a lower handle member comprising a first end and an opposed second end, said upper handle member and said lower handle member being spaced apart and parallel;

a ratchet head pivotably connected to said first end of said upper handle member and said first end of said lower handle member, said ratchet head comprising a bi-directional ratcheting mechanism; and, a ring grip pivotably connected to said second end of said upper handle member and said second end of said lower handle member, said ring grip comprising an annularly-shaped body defining a circular ring grip aperture;

wherein said ratchet head occupies a first reference plane throughout said ratchet head pivot range of motion;

wherein said ring grip occupies a second reference plane throughout said ring grip pivot range of motion;

wherein said upper handle member and said lower handle member mechanically maintain said first reference plane and said second reference plane in a parallel relationship regardless of a pivoted position of said ratchet head and said ring grip relative to said handle member in response to pivoting movement of one of said ratchet head or said ring grip; and, wherein said ratchet head and said ring grip each pivot perpendicularly relative to said upper and lower handle members, respectively.

15. The device of claim 14, wherein:

said first end of said upper handle member is pivotably connected to said ratchet head at a first upper hinge;

said first end of said lower handle member is pivotably connected to said ratchet head at a first lower hinge;

said second end of said upper handle member is pivotably connected to said ring grip at a second upper hinge; and, said second end of said lower handle member is pivotably connected to said ring grip at a second lower hinge.

16. The device of claim 15, wherein:

said first upper hinge comprises an integral first upper handle knuckle extending from said first end of said upper handle member and an integral spaced apart upper pair of head knuckles extending from said ratchet head to receive said first upper handle knuckle, said first upper handle knuckle being secured between said upper pair of head knuckles by a first pin;

said first lower hinge comprises an integral first lower handle knuckle extending from said first end of said lower handle member and an integral spaced apart lower pair of head knuckles extending from said ratchet head to receive said first lower handle knuckle, said first lower handle knuckle being secured between said lower pair of head knuckles by a second pin;

said second upper hinge comprises an integral second upper handle knuckle extending from said second end of said upper handle member and an integral spaced apart upper pair of grip knuckles extending from said ring grip to receive said second upper handle knuckle, said second upper handle knuckle being secured between said upper pair of grip knuckles by a third pin; and, said second lower hinge comprises an integral second lower handle knuckle extending from said second end of said lower handle member and an integral spaced apart lower pair of grip knuckles extending from said ring grip to receive said second lower handle knuckle, said second lower handle knuckle being secured between said lower pair of grip knuckles by a fourth pin.

17. The device of claim 16, wherein:

said ratchet head comprises a ratchet head pivot range of motion of approximately ninety degrees relative to said first end of said handle member; and, said ring grip comprises a ring grip pivot range of motion of approximately ninety degrees relative to said second end of said handle member.

* * * * *